US008764219B2

(12) United States Patent
Hasan et al.

(10) Patent No.: US 8,764,219 B2
(45) Date of Patent: Jul. 1, 2014

(54) SEALED LED LIGHT FIXTURE FOR USE IN FOOD PROCESSING APPLICATIONS

(75) Inventors: Syed Q. Hasan, Sugar Land, TX (US); Anibal Z. Rosado, Pearland, TX (US); William E. Martin, Croswell, MI (US)

(73) Assignee: Rig-A-Lite Partnership, Ltd., Houston, TX (US)

( * ) Notice: Subject to any disclaimer, the term of this patent is extended or adjusted under 35 U.S.C. 154(b) by 0 days.

(21) Appl. No.: 13/605,721

(22) Filed: Sep. 6, 2012

(65) Prior Publication Data

US 2014/0063793 A1 Mar. 6, 2014

(51) Int. Cl.
*F21L 4/02* (2006.01)

(52) U.S. Cl.
USPC ..... 362/184; 362/545

(58) Field of Classification Search
USPC ..... 362/184, 544–545, 239, 250
See application file for complete search history.

(56) References Cited

U.S. PATENT DOCUMENTS 7,287,347 B2 10/2007 Hasan
2009/0290334 A1* 11/2009 Ivey et al. ..... 362/219
2013/0058076 A1* 3/2013 Ni ..... 362/184

OTHER PUBLICATIONS

FPF Series, Non-Metallic Fixture for Food Processing, Zazz/R-A-L Rig-A-Lite, Sep. 2012.

* cited by examiner

*Primary Examiner* — Anne Hines
(74) *Attorney, Agent, or Firm* — Gary L. Bush; Andrews Kurth LLP

(57) ABSTRACT

A light fixture having a "U"-shaped frame inside a sealed cylindrical housing. Mounted along the center of the face of the frame are one or more LED lamp panels, which include a number of LEDs, some of which may be powered by a back-up source such as an optionally supplied battery for emergency egress lighting. The lamp panels are mounted using a thermal interface material to promote heat transfer from the LED lamp panels to the frame, which in turn radiates the heat into the volume of the housing to enhance cooling. To each side of the LED lamp panels, a highly polished reflector is attached to the frame to focus and concentrate the light while simultaneously shielding the LEDs from heat radiated from the frame. Attached to the obverse side of the frame is a "U"-shaped back cover that forms an electrical enclosure. An optional diffuser may be supplied.

10 Claims, 9 Drawing Sheets

SEALED LED LIGHT FIXTURE FOR USE IN FOOD PROCESSING APPLICATIONS

BACKGROUND OF THE INVENTION

1. Field of the Invention

This invention relates generally to specialty light fixtures, and specifically to fixtures for use in food processing applications.

2. Description of the Prior Art

Sealed light fixtures capable of withstanding high-pressure wash down and presenting minimal nooks, crannies, surface area that cannot be easily accessed for cleaning and/or sterilization are known in the prior art. For example, Rig-A-Lite Partnership, Ltd., of Houston, Tex. manufactures a variety of fluorescent light fixtures for use in food processing industries. One feature that is common among such light fixtures is that the entire fixture is contained within a sealed housing made only of non-corrosive plastic, glass or stainless steel materials. The shape of the housing facilitates wash-down and watershed. Some lights carry various certifications, including National Science Foundation (NSF) certification for food equipment and Underwriters Laboratories (UL) certifications.

While fluorescent light fixtures are available for use in food preparation applications, these fixtures have shortcomings. For example, fluorescent light bulbs have a shorter life span than some other types of lighting, such as light emitting diodes (LEDs). While changing fluorescent tubes is an annoying task at the best of times, it becomes a far greater nuisance when the sealed housing must be disassembled and then reassembled in order to change the bulbs. Further, repeated disassembly of the sealed fixture wears o-rings and gaskets and introduces risk that the light fixture might leak under the stress of a high pressure wash down. In addition, the quality and color of the fluorescent light produced is considered by some to be less desirable than that provided by LEDs.

The problem with using LEDs in sealed light fixtures, however, is that LEDs are adversely affected by excess heat. This feature has heretofore prevented wide use of LEDs in sealed light fixtures, because enclosing the LEDs in a sealed housing traps the heat generated by the LEDs, thereby elevating the ambient temperature immediately surrounding the LEDs to an unacceptable level, causing them to perform poorly.

3. Identification of Objects of the Invention

An object of the invention is to provide an LED light fixture that overcomes the disadvantages of the prior art.

Another object of the invention is to provide an LED light fixture where the light emitting diodes are enclosed within a sealed enclosure and heat is dissipated away from the LEDs.

Another object of the invention is to provide a light fixture suitable for use in areas where food is processed or prepared.

Another object of the invention is to provide a light fixture suitable for use in commercial or industrial food preparation settings or similar wet environments that eliminates the requirement for external redundant power or separate emergency lighting fixtures by including an internal battery backup.

SUMMARY OF THE INVENTION

The objects identified above, as well as other features of one or more embodiments of the invention are incorporated in a light fixture having a frame disposed within a transparent tube. Plastic or stainless steel circular housing covers are mounted to the frame and together with the tube form a sealed cylindrical housing generally centered about the frame.

Mounted along the center of the face of the frame are one or more LED lamp panels, which include a number of LEDs, some of which may be powered by a back-up source of power such as a battery for emergency egress lighting. The LED lamp panels are mounted using a thermal pad, gel, grease, coating, or other agent to promote heat transfer from the LED lamp panels to the frame, which in turn radiates the heat into the volume of the housing to enhance heat transfer to the outside atmosphere. To each side of the LED lamp panels, a highly polished reflector is attached to the frame to focus and concentrate the light while simultaneously shielding the LEDs from heat radiated from the frame.

In a preferred embodiment, the frame is characterized by a wide "U"-shaped profile defining a central face and left and right wings. Attached to the obverse side of the frame face is a "U"-shaped back cover, that together with the frame forms an electrical enclosure in which a power supply circuit and optional battery are located.

An optional transparent or translucent diffuser panel is mounted alongside and covers the LED light panels to provide a more attractive fixture and more uniform light emission. The diffuser panel may include, for example, a scalloped, ribbed, diamonded, or prismatic outer surface texture, or alternatively, may have a light frosted translucent body, which softens and diffuses the light output and obscures the individual LEDs.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
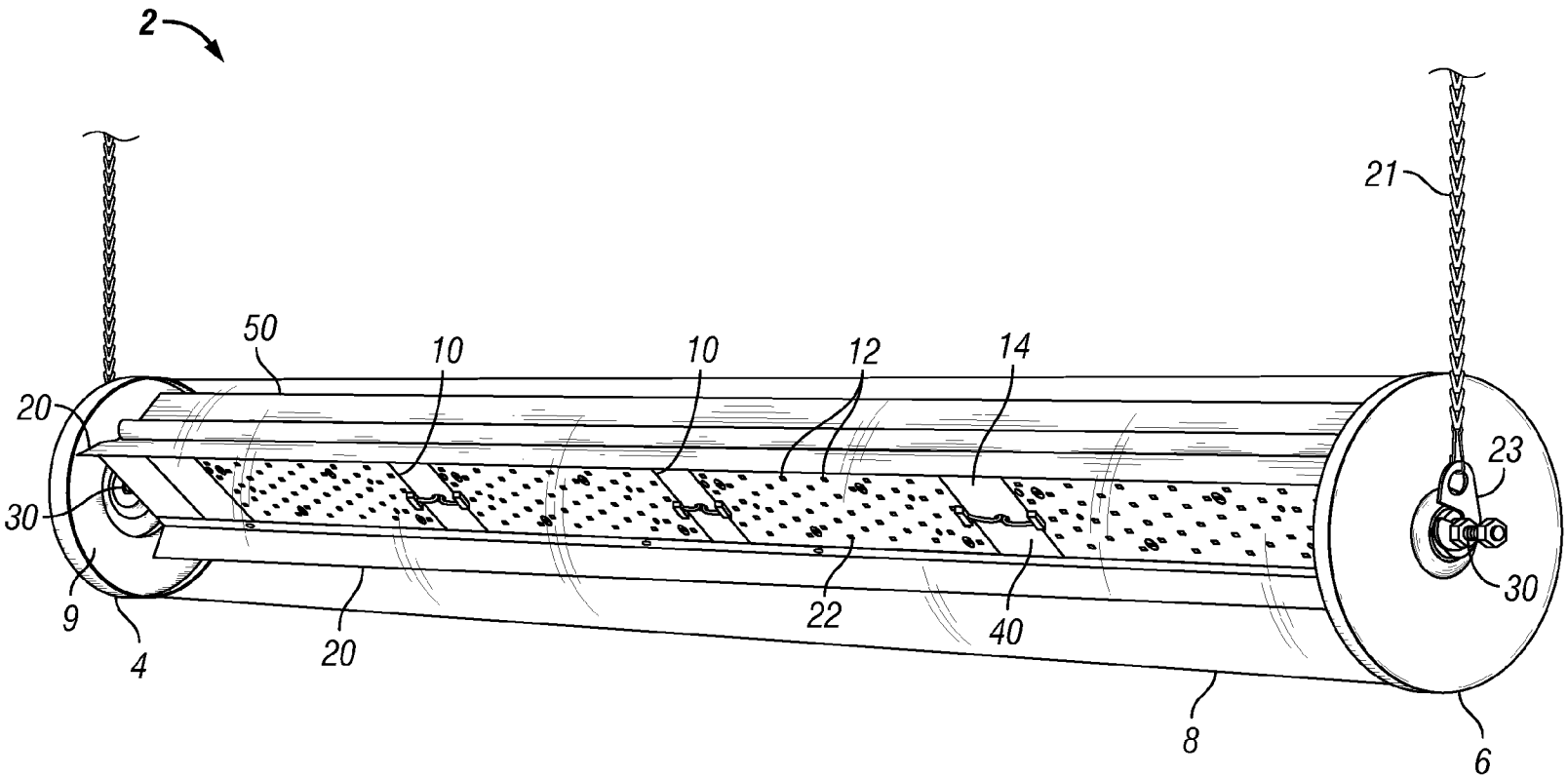
FIG. 1 is a perspective view of a LED light fixture according to a preferred embodiment of the invention, showing a frame with LED light panels mounted thereon disposed within a sealed, cylindrical housing.
Figure 2:
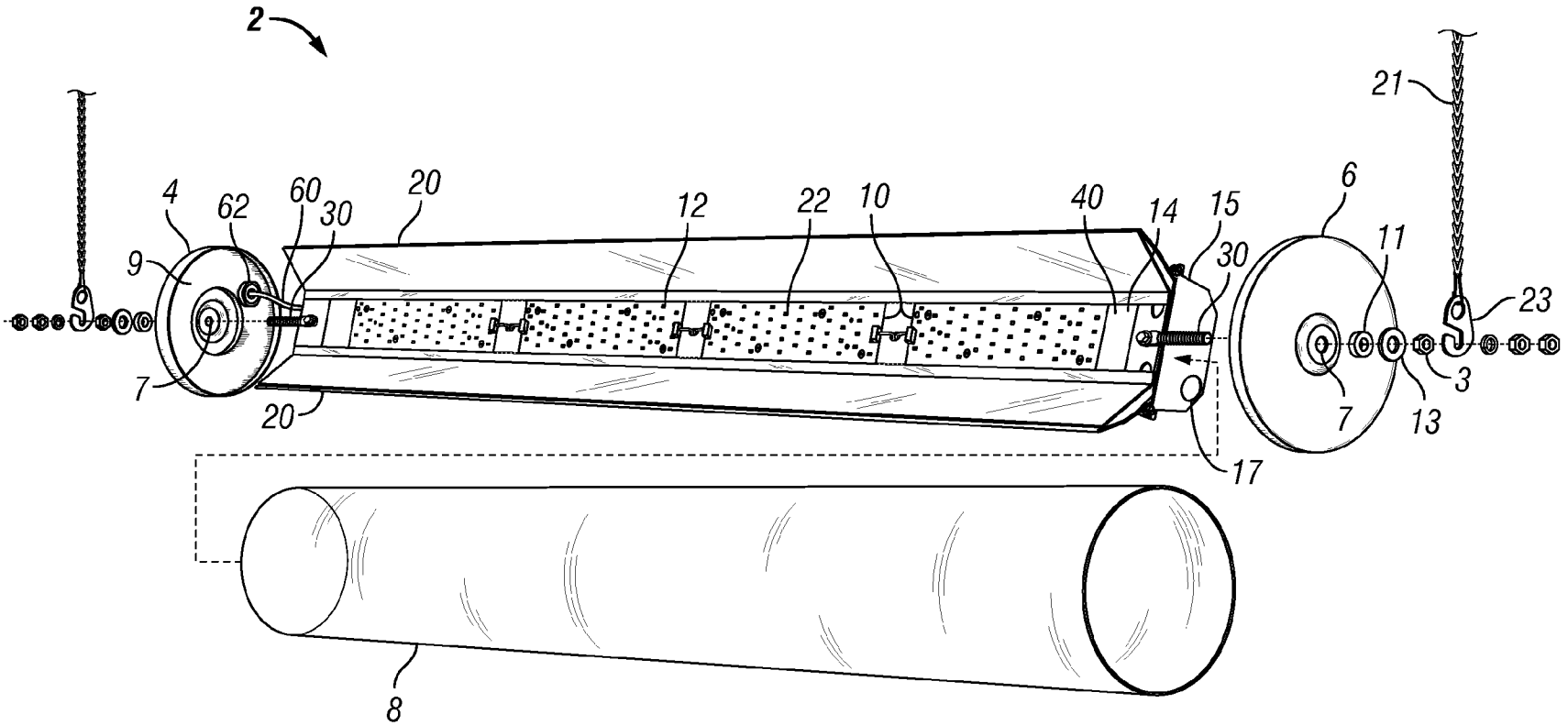
FIG. 2 is a partially exploded diagram of the LED light fixture of FIG. 1, showing details of the sealed housing that surrounds all lamp components.

FIG. 1 shows a perspective view of an LED fixture 2 according a preferred embodiment of the invention. FIG. 2 is a partially exploded diagram of FIG. 1. Referring to both FIGS. 1 and 2, the LED fixture 2 includes a frame 14, which is preferably elongate and formed of extruded aluminum, although other shapes, heat conductive materials, and manufacturing processes may be used. Connected at each end of frame 14 is a threaded rod 30. Frame 14 is disposed within a transparent elongate tube 8, which may be made of polymer or glass, so that rods 30 are centered along the longitudinal axis of tube 8. First and second housing covers 4, 6 each have a central hole 7 formed therethrough through which rods 30 are received. First and second housing covers 4, 6 are preferably made of corrosion-resistant polymer or stainless steel and each include a gasket 9 and are dimensioned to receive transparent tube 8 against the gasket 9. A resilient grommet 11, a washer 13, and a nut 3 are thereafter assembled onto each threaded rod 30, and when tightened, compress housing covers 4, 6 and tube 8 into sealing engagement against gaskets 9 and compress the grommets 11 into sealing engagement between covers 4, 6 and threaded rods 30 to form a sealed cylindrical housing mounted to and generally centered about frame 14. Gaskets 9 and grommets 11 may be made of any appropriate sealant material as is well known in the art. Mounting hardware, such as chains 21 terminated with flattened hook fittings 23, may thereafter be secured to threaded rods 30 for hanging fixture 2 from an overhead structure. Preferably, rods 30, washers 13, nuts 3, chains 21, hooks 23, and any other mounting hardware are stainless steel. LED fixture 2 is therefore suitable for installation in wet locations and marine environments where it may be subjected to high pressure wash down, salt water spray, or other moisture.

Mounted along the center of the face 40 of frame 14 are one or more LED lamp panels 10, which include a number of LEDs 12 and which may optionally include emergency lighting LEDs 22. As shown in FIGS. 1 and 2, a longitudinal row of four LED lamp panels 10 are attached to frame 14, but a different number and/or a different configuration or arrangement of lamp panels may be provided as appropriate. To each side of the row of LED lamp panels 10, a highly polished reflector 20 is attached to frame 14. Reflectors 20 help to focus and concentrate the light created by fixture 2 while simultaneously shielding the LEDs from heat radiated from frame 14, as described further below.

Figure 3:
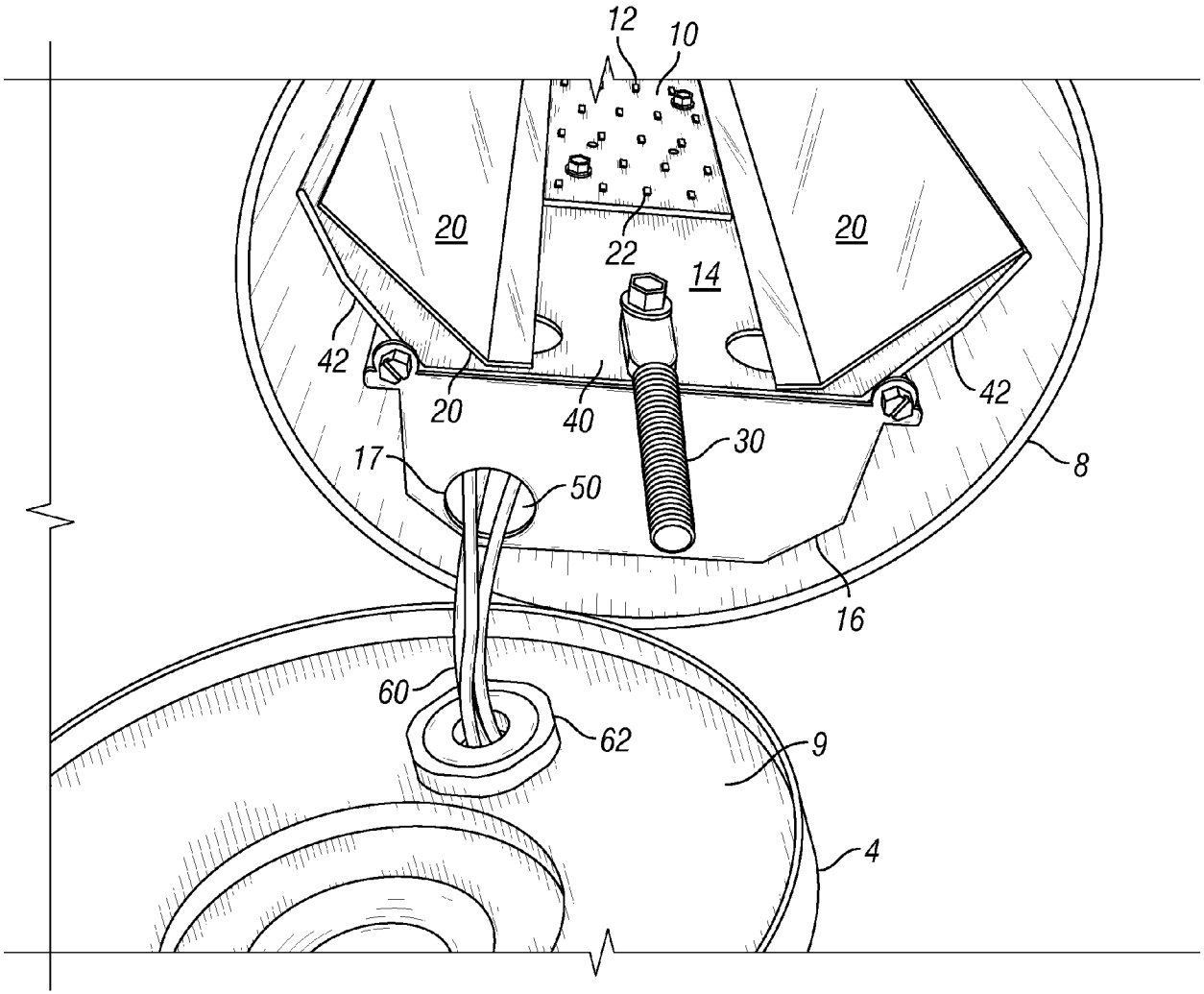
FIG. 3 is a perspective view of the power end of the LED light fixture of FIG. 1 shown with a housing cover unfastened and tilted downward from the fixture frame to reveal power wires, a threaded mounting rod, a LED light panel, and reflector fins.
Figure 4:
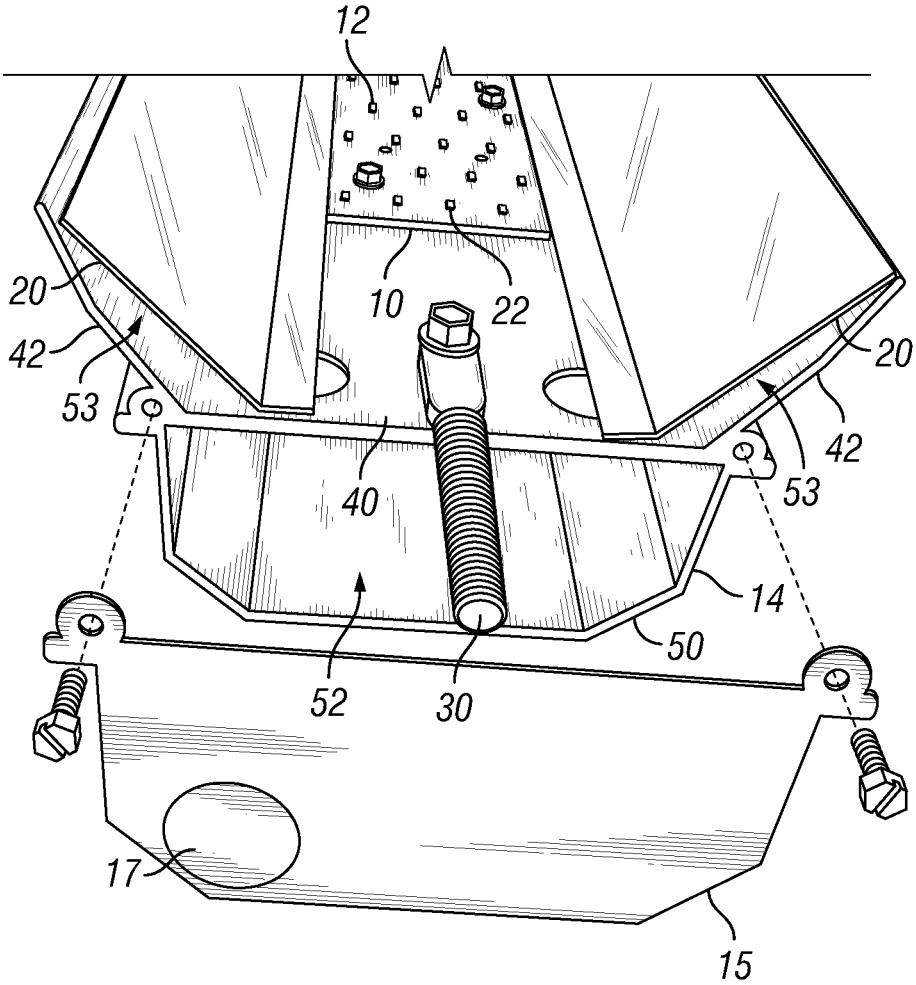
FIG. 4 is a partially exploded perspective diagram of the non-power end of the frame of the LED light fixture of FIG. 1, showing a disconnectable cover plate and an attached back cover to define an electrical enclosure for housing power supply and battery components.

FIG. 3 is a perspective view of fixture 2 with housing cover 4 unscrewed and removed from threaded rod 30 to provide access to the "power" end of frame 14 within tube 8. "Power end" simply refers to the fact that the electrical power lead 60 is located at that end. Similarly, FIG. 4 is a partially exploded diagram of the non-power end of frame 14 (shown without tube 8 or housing cover 6). As can be seen from these figures, frame 14 is preferably characterized by a wide "U"-shaped profile defining a central face 40 and left and right wings 42. Among other benefits, the "U"-shape serves to increase rigidity. Alternatively, frame 14 may have other than a "U"-shaped profile. LED lamp panels 10, reflectors 20, and threaded rods 30 are screwed or bolted to face 49 of frame 14. However, LED lamp panels 10 may be attached to frame 14 by any acceptable means.

Attached to the obverse side of frame face 40 is a "U"-shaped, preferably elongate, back cover 50. Back cover 50 is preferably roll-formed aluminum, although other materials and/or manufacturing processes may be used as known to those skilled in the art. The obverse side of frame face 40 includes left and right slots, and left and right flanges of back cover 50 are either slid or compressed and positioned into the slots. The assembly of frame 14 and back cover 50 form an elongate electrical enclosure 52, which is closed at each end with cover plates 15, 16 that are screwed into the ends of the extruded frame 14. Cover plates 15, 16 each preferably include a stamped knockout plug fitting 17 as is commonly provided with electrical junction boxes, enclosures, and the like. The slug of knockout plug fitting 17 is removed from the power end cover plate 16 to provide for the passage of electrical leads 60 from enclosure 52 to a watertight port or connector 62 in power end housing cover 4.

Figure 5:
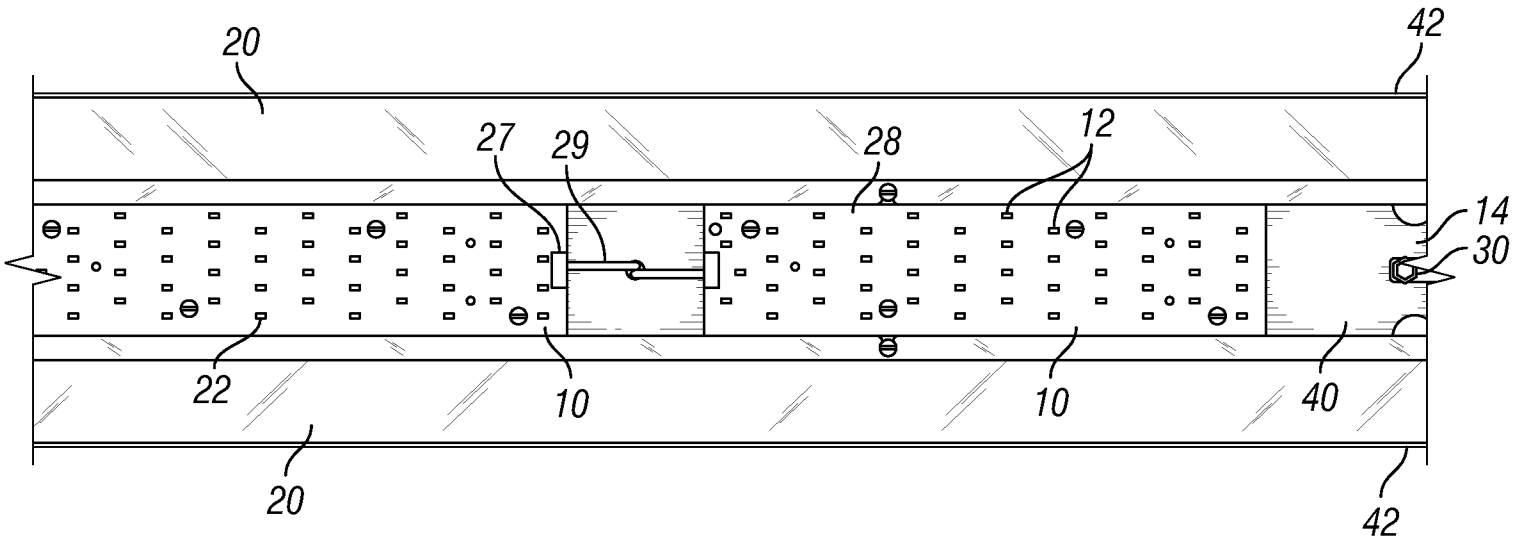
FIG. 5 is an orthogonal view of the bottom, i.e., the illuminating face, of a portion of the LED light fixture of FIG. 1, showing a frame, reflective fins, and LED light panels having regular and emergency lighting back-up LEDs.
Figure 6:
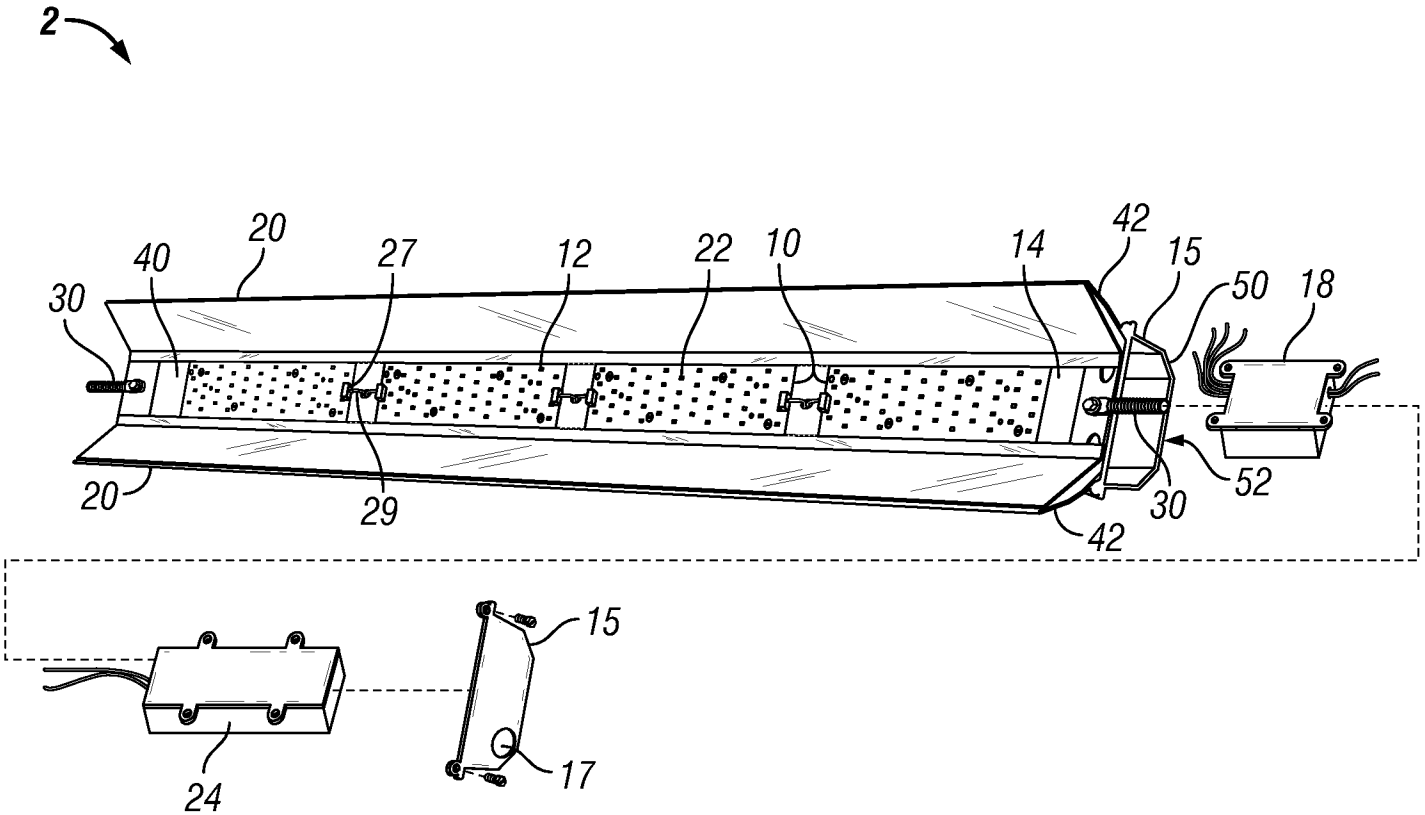
FIG. 6 is a partially exploded diagram of the frame assembly of FIG. 1, showing a power supply, rechargeable battery, and enclosure cover plate.

FIG. 5 shows the illuminating face of light fixture 2. FIG. 6 shows the power supply components located within electrical enclosure 52. Referring to both FIGS. 5 and 6, each lamp panel 10 includes a number of LEDs, preferably surface mount devices, carried on a printed circuit board 28. The LEDs of each lamp panel 10 are wired in an electrical circuit using conductive traces (not illustrated) on printed circuit board 28, as is well known in the prior art. All of the printed circuit boards 28 also carry one or more electrical connectors 27, which electrically connect the LEDs to one or more power supply circuits 18 via a wiring harness 29. The power supply circuits 18 are in turn connected to line power via leads 60 (FIGS. 2-3).

Power supply 18 includes transformer and rectifier circuitry to convert A/C line voltage power to low voltage D/C power, as is well known in the art. Preferably, the fixture is configured to operate on 480V 50/60 Hz maximum, depending on the power connection available at a given site. Power supply circuit 18 is preferably a class 2 power supply suitable for damp locations, thermally protected, and cold weather rated. Additionally, power supply circuit 18 may include circuitry for dimming the LEDs, as is known in the art. Power supply 18 is preferably mounted to the obverse side of frame face 40 within electrical enclosure 52. Electrical harness 29 passes within holes formed through frame face 40 to connect the outputs of power supply 18 to LED lamp panels 10.

In a first embodiment, all LED lamp panels 10 of fixture 2 are populated with LEDs 12 that intended for ordinary illumination. In a second embodiment, a majority of some lamp panels 10 are populated with ordinary illumination LEDs 12, but at least one lamp panel 10 is entirely populated with emergency back-up lighting LEDs 22. In a third embodiment, fixture 2 may include one or more LED lamp panels 10 that are populated with a mixture of ordinary illumination LEDs 12 and emergency back-up lighting LEDs 22. The distribution of ordinary LEDs 12 and backup LEDs 22 may be arranged in any appropriate configuration.

LEDs 12 and LEDs 22 may be identical devices, the only difference being the supply of power. Typically, backup LEDs 22 are wired to a separate backup power source, which may be supplied by an emergency generator or by a battery, for example. Depending on the application, emergency back-up lighting LEDs 22 may be operated both during normal conditions and during power outage, or they may be operated only during power outage.

For example, according to one embodiment, backup LEDs 22 are wired to a separate backup circuit that includes a rechargeable battery 24, which in turn may be maintained in a charged state by a conventional power supply circuit 18. Battery 24 is ideally a high-temperature rated nickel cadmium battery, although other battery typed may be used as appropriate. In the event of an external power failure, battery 24 continues to power LEDs 22 to provide a minimal amount of illumination to permit safe egress. LED fixture 2 may also include an indicator light (not illustrated) that illuminates when the battery 24 is recharging, thereby giving visual indication of the state of battery 24. Battery 24 is preferably mounted to the obverse side of frame face 40 within electrical enclosure 52.

Figure 7:
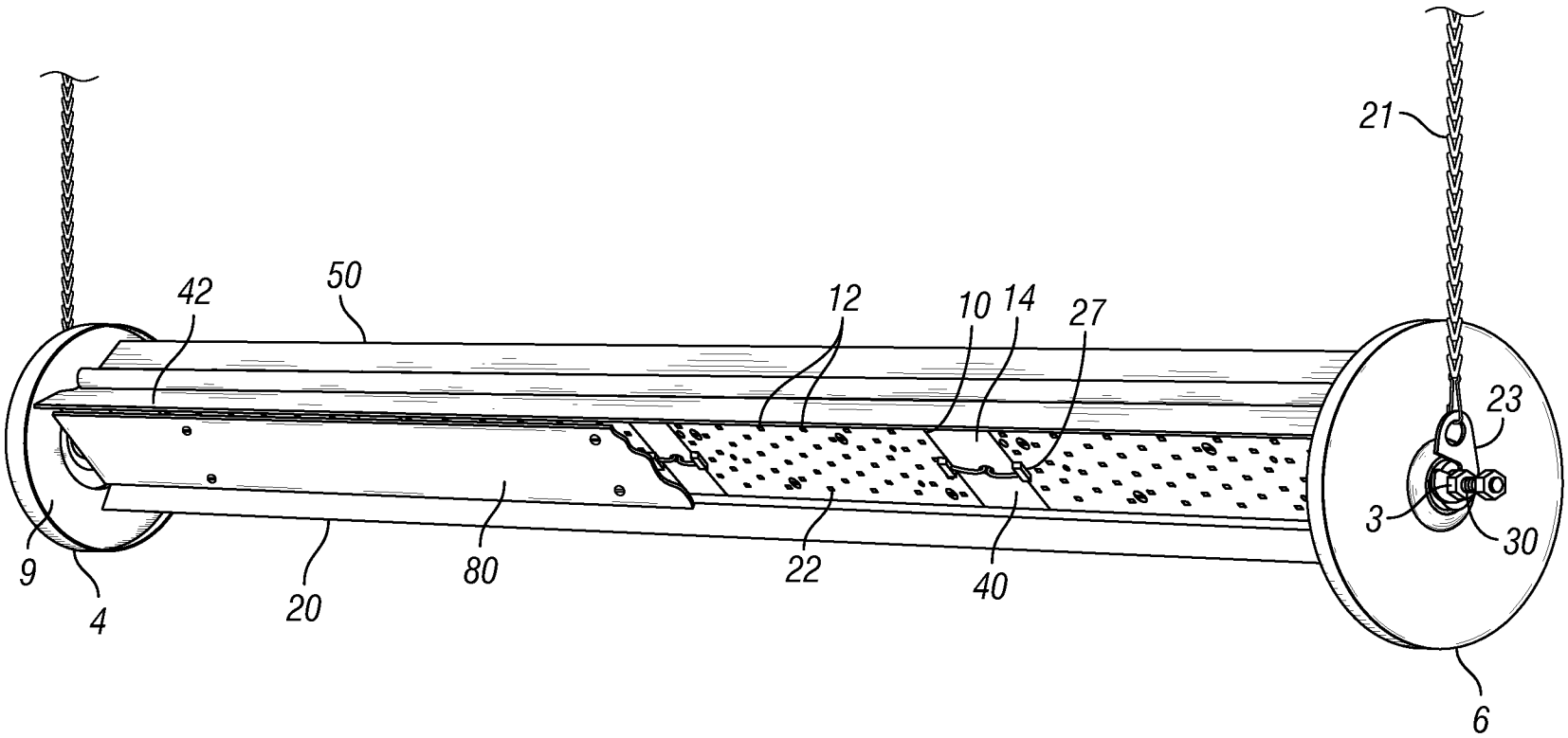
FIG. 7 is a perspective view of the LED light fixture of FIG. 1 according to an alternative embodiment of the invention, shown with the transparent tube removed to reveal a cut away transparent or translucent diffuser panel mounted alongside and covering the LED light panels.
Figure 8:
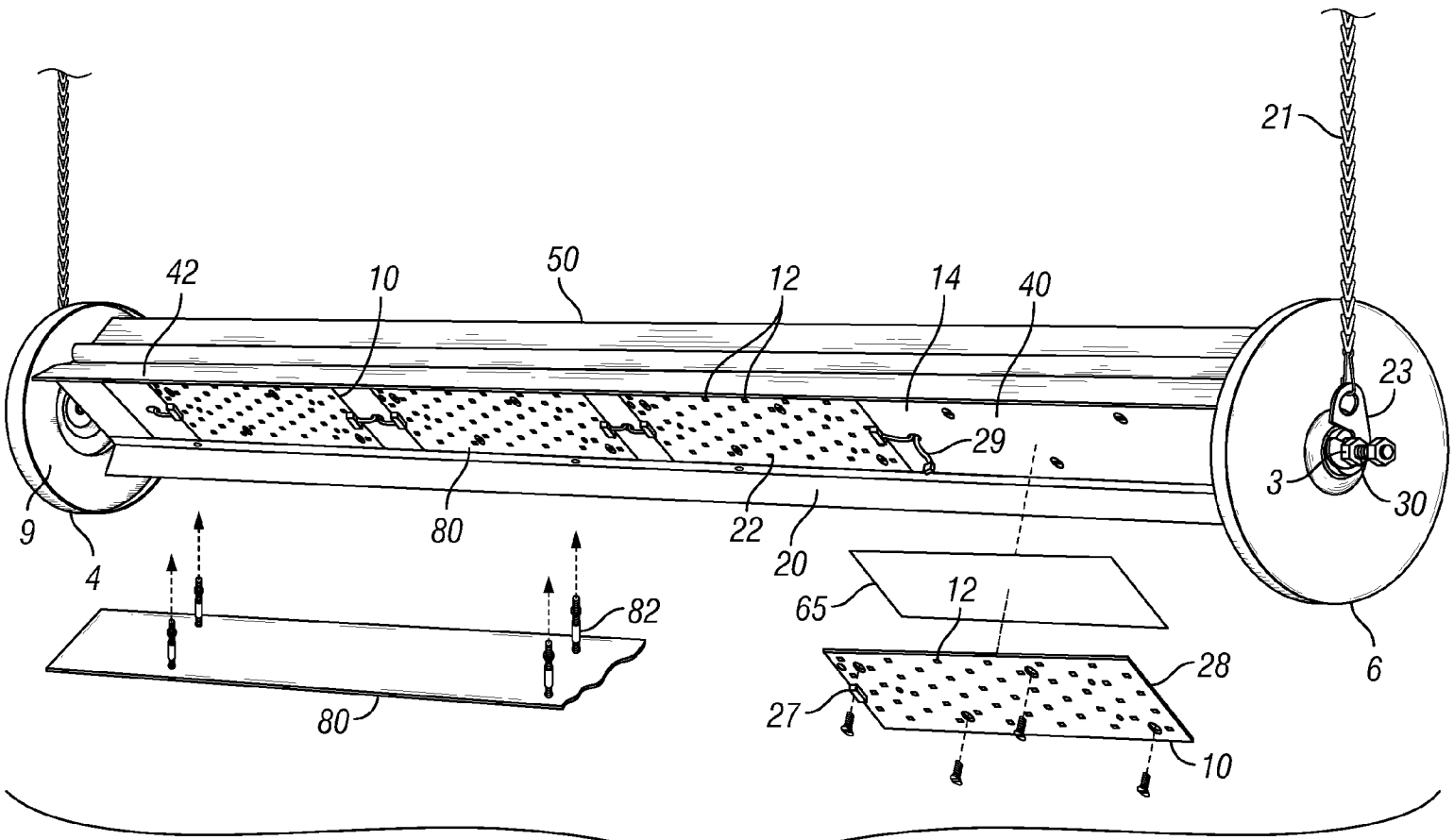
FIG. 8 is a partially exploded diagram of the LED light fixture of FIG. 7, showing the preferred mounting arrangements for the diffuser panel and the LED lamp panels.

FIG. 7 is a perspective view of the LED light fixture of FIG. 1 (shown without transparent tube 8) according to an alternative embodiment of the invention that includes a transparent or translucent diffuser panel 80 (which is shown partially cut away) mounted alongside and covering the LED light panels 10. FIG. 8 is a partially exploded diagram of the LED light fixture of FIG. 7, showing the preferred mounting arrangements for the diffuser panel 80 and the LED lamp panels 10. Referring to both FIGS. 7 and 8, optional diffuser panel 80 may be installed to provide a more attractive fixture 2 and more uniform light emission. Diffuser panel 80 may include, for example, a scalloped, ribbed, diamonded, or prismatic outer surface texture, or alternatively, may have a light frosted translucent body, which softens and diffuses the light output and obscures the individual LEDs. Such diffuser panels are known in the art. Diffuser panel 80 is preferably mounted to the face 40 of frame 14 using screws and standoff spacers 82, which provide clearance between LED lamp panels 10 and diffuser panel 80.

When operating, LEDs both generate heat and are adversely affected by elevated temperatures. Heat generated by fixture 2 must therefore be effectively dissipated to keep the LED operating temperature within an acceptable level. The configuration of the present invention effectively achieves this requirement. Referring to FIG. 8, the back side of LED lamp panels 10 is covered with a thin thermally conductive pad, gel, tape, coating, adhesive, grease, or other compound 65 before the panel 10 is mounted to face 40 of frame 14. Thermal pad 65 acts as a wetting agent the wets the back surface of the lamp panel 10 and the face 40 or frame 14, thereby increasing the heat transfer surface area. Because LED lamp panels 10 are mounted to be in direct and full thermal contact with frame 14 via thermal pad 65, aluminum frame 14 sinks heat generated by LEDs 12, 22. Wings 42 and, to a lesser extent, back cover 50, help to radiate the heat to the rear of the fixture, where it is more readily dissipated into the volume of the sealed housing thereby enhancing heat transfer across tube 8 and housing covers 4, 6 into the ambient atmosphere.

Referring back to FIG. 4, reflectors 20 are shaped and mounted to frame 14 in such a manner so as to create a small volume 53 between each wing 42 and its adjacent reflector 20. Not only does reflector 20 reflect light forward from LEDs 12, 22, it also reflects heat radiated by wings 42 backwards, away from the LEDs. The air in volume 53 further acts as an insulator.

Figure 9:
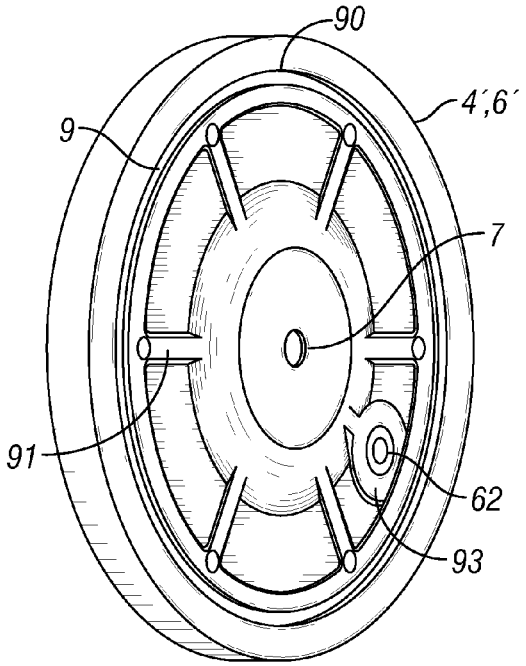
FIG. 9 is a perspective view of a housing cover of the LED light fixture of FIG. 1 according to a first embodiment of the invention, showing the interior side of a plastic cover with a central mounting hole, reinforcement ribbing, a circular grooved seat with gasket, and a port for connection to watertight conduit or other power connection.

FIG. 9 is a perspective view of the interior side of plastic housing cover 4', 6' of the LED light fixture of FIG. 1 according to one embodiment of the invention. Housing cover 4', 6' has a central mounting hole 7 for receiving threaded rod 30 (FIG. 2). Formed within housing cover 4', 6' is a circular groove 90 having an outer diameter slightly greater than the outer diameter of tube 8 (FIG. 2) and an inner diameter slightly less than the inner diameter of tube 8 so that tube 8 fits comfortably within groove 90. A circular gasket 9 is disposed within groove 90. Housing cover 4', 6' includes a raised center portion, raised circumferential portion, and raised ribs 91 in a spoke arrangement to provide the required strength and rigidity. Housing cover 4', 6' also includes a raised flat 93 with molded circular indicium that defines the location of a hole to be drilled when a power port 62 is installed. The only difference between housing cover 4' and housing cover 6' is that the former includes power port 62 for connection to watertight conduit or other power connection. The exterior side of housing cover 4', 6' (not illustrated) preferably includes a small, shallow, circular recess formed coaxially about central hole 7 into which grommet 11 (FIG. 2) is seated.

Figure 10:
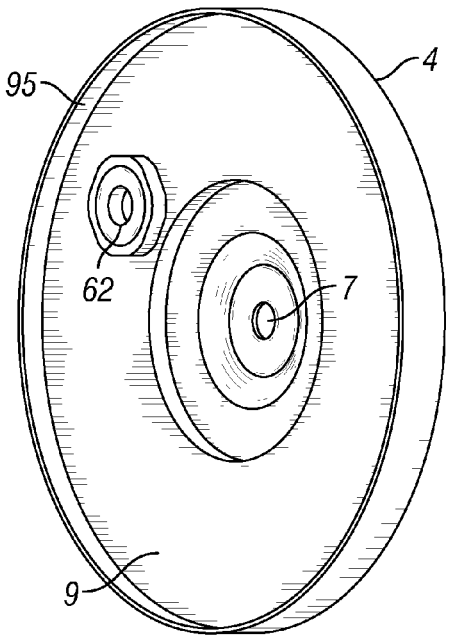
FIG. 10 is a perspective view of a housing cover of the LED light fixture of FIG. 1 according to an alternative embodiment of the invention, showing the interior side of a stainless steel cover with a central mounting hole, gasket and a power port.
Figure 11:
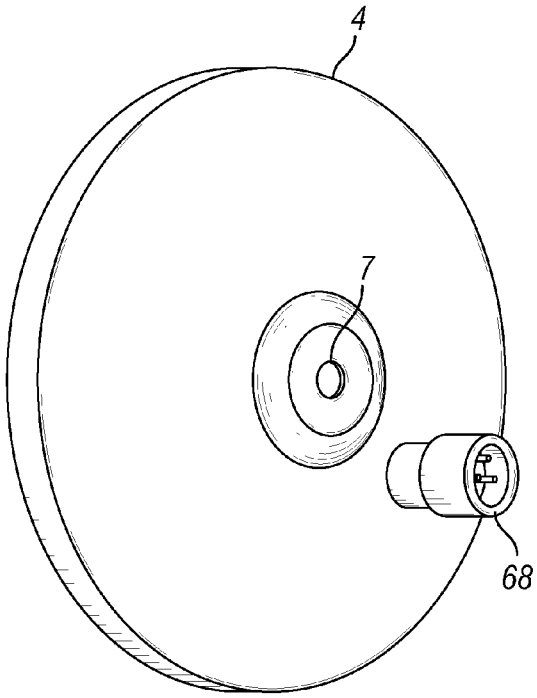
FIG. 11 is a perspective view of the exterior side of the housing cover of FIG. 11 shown with a watertight power connector according to an embodiment of the invention.

FIGS. 10 and 11 are perspective views of the interior and exterior sides, respectively, of a stainless steel housing cover 4 according to another embodiment of the invention. The outer circumference of cover 4 terminates as an inward-facing flange having an inner diameter just greater than the outer diameter of tube 8 (FIG. 2) so that cover 4 comfortably fits over tube 8. A wide circular gasket sheet 9 is adhered to the inner surface of cover 4 right up to flange 95 so that an effective seal can be made against tube 8. Housing cover 4 includes a central hole 7 formed therethrough for receiving threaded rod 30 (FIG. 2) and a power port 62. As shown in FIG. 11, a watertight connector 68 may optionally be installed in port 62, although a threaded connection to watertight conduit may be used as well. A non-power-end stainless steel housing cover 6 (FIG. 2) is substantially identical to cover 4, except that it does not include port 62.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While the preferred embodiment of the invention has been illustrated in detail, the invention is not limited to the embodiment shown. It is apparent that modifications and adaptations of the above embodiment may occur to those skilled in the art. Such modifications and adaptations are in the spirit and scope of the invention as set forth herein.

What is claimed is:

1. A light fixture (2), comprising:

a metallic frame (14) including a central planar section (40) and first and second wings (42) extending angularly downward from said center section;

a first plurality of light emitting diodes (12) mounted and thermally coupled to said central planar section of said frame (14);

first and second reflectors (20) mounted to said frame so as to substantially cover downward-facing sides of said first and second wings, respectively; and a sealed housing enclosing said frame, said first and second reflectors, and said first plurality of light emitting diodes; whereby said frame draws heat away from said plurality of light emitting diodes; and said first and second reflectors (20) focus and concentrate light emitted by said first plurality of light emitting diodes (12) and reflect heat radiated by said first and second wings (42), a first gap (53) disposed between said first reflector and said first wing; and a second gap (53) disposed between said second reflector and said second wing; whereby said first and second gaps act as insulators.

2. The light fixture of claim 1 further comprising:

a printed circuit board (28) carrying said plurality of light emitting diodes;

a thermally conductive interface member (65) disposed between and in contact with said printed circuit board (10) and said frame (14), said interface member (65) being operative to act as a conductive agent between a first surface area of said frame (14) and a second surface area of said printed circuit board (10) so as to maximize heat transfer from said printed circuit board (10) to said frame (14).

3. The light fixture of claim 1 further comprising:

an electrical enclosure (52) disposed within said sealed housing.

4. The light fixture of claim 3 wherein:

said electrical enclosure is formed in part by at least a portion of said frame.

5. The light fixture of claim 3 further comprising:

a power supply circuit (18) disposed within said electrical enclosure.

6. The light fixture of claim 3 further comprising:

a battery (24) disposed within said electrical enclosure.

7. The light fixture of claim 1 further comprising:

a second plurality of light emitting diodes (22);

a first power supply and a second power supply coupled respectively to said first and second pluralities of light emitting diodes;

a first wiring arrangement (60) connected to said first power supply (18) and designed and arranged for connecting said first power supply (18) to a first source of electrical power; and a second wiring arrangement connected to said second power supply (18) and designed and arranged for connecting to a second source of power that is independent of said first source of power; wherein said second plurality of light emitting diodes are enabled to illuminate when said power from said first power supply circuit is lost.

8. The light fixture of claim 7 wherein:

said second source of power includes a battery (24) disposed within said sealed housing.

9. The light fixture of claim 7 further comprising:

a first printed circuit board (28) carrying said first plurality of light emitting diodes; and a second printed circuit board (28) carrying said second plurality of light emitting diodes.

10. The light fixture of claim 7 further comprising:

a printed circuit board (28) carrying said first and second pluralities of light emitting diodes.

* * * * *